US006321470B2

(12) United States Patent
Zazzi

(10) Patent No.: US 6,321,470 B2
(45) Date of Patent: Nov. 27, 2001

(54) BOOT MOUNTED SNOWBOARD SUPPORT

(76) Inventor: Andrew J. Zazzi, 16125 Yona Vista Ave., San Jose, CA (US) 95127

( * ) Notice: Subject to any disclaimer, the term of this patent is extended or adjusted under 35 U.S.C. 154(b) by 0 days.

(21) Appl. No.: 09/755,257

(22) Filed: Jan. 4, 2001

Related U.S. Application Data

(63) Continuation of application No. 09/345,433, filed on Jul. 1, 1999.

(51) Int. Cl.[7] ..... A43B 5/00

(52) U.S. Cl. ..... 36/132; 36/132; 36/54; 36/72 R; 36/117.1

(58) Field of Search ..... 36/113, 114, 117.1, 36/132, 136, 72 R, 54, 77 R

(56) References Cited

U.S. PATENT DOCUMENTS

| | | | |
|---|---|---|---|
| 535,816 | 3/1895 | Cushman . | |
| 1,164,810 | 12/1915 | Hammond . | |
| 1,426,668 | 8/1922 | Pardee et al. . | |
| 1,867,036 | 7/1932 | Strauss . | |
| 3,082,553 | 3/1963 | Wilmanns . | |
| 3,226,849 | 1/1966 | Rosen . | |
| 3,995,382 | 12/1976 | Smith | 36/72 R |
| 4,741,550 | 5/1988 | Dennis | 280/618 |
| 4,940,255 | 7/1990 | Donine | 280/809 |
| 5,074,060 | 12/1991 | Brncick et al. | 36/77 R |
| 5,313,719 | 5/1994 | Koethe | 36/72 R |
| 5,564,729 | 10/1996 | Gomez et al. | 280/637 |
| 5,649,376 | 7/1997 | Lecates, Jr. | 36/137 |
| 5,653,467 | 8/1997 | Griffin et al. | 280/809 |
| 5,722,867 | 3/1998 | LaGrow | 441/70 |

FOREIGN PATENT DOCUMENTS 2126872A 4/1984 (GB) .

*Primary Examiner*—Paul T. Sewell
*Assistant Examiner*—Jila M. Mohandesi
(74) *Attorney, Agent, or Firm*—Thomas Schneck

(57) ABSTRACT

A scuffing protector for shielding a standard snowboard boot from the edge of a snowboard during the ride up a chairlift is disclosed. Snowboard riders traditionally remove one of their boots from its binding for the ride up the chairlift. The free boot allows the rider to maneuver through the chairlift lines and onto the chairlift itself. The snowboard boot protector is removably attached to the dorsal surface of the free boot of a snowboarder, so when riding the chairlift, the snowboard can rest upon the boot protector without causing any damage to the free boot. The boot protector is composed of a tough plastic or rubber material that has both flexibility and durability. Additionally, the boot protector is strong enough to support the weight of the snowboard, so as to equalize the load between both legs.

10 Claims, 6 Drawing Sheets

BOOT MOUNTED SNOWBOARD SUPPORT

CROSS-REFERENCE TO RELATED APPLICATION

This application is a continuation of application Ser. No. 09/345,433 filed Jul. 1, 1999.

TECHNICAL FIELD

This invention relates to protective devices for boots. In particular, the invention relates to appliances that shield a snowboard boot from scuffing.

BACKGROUND ART

Snowboarding has evolved rapidly. What was once a minor sport, has now joined the mainstream. Yet snowboard riders have had to accustom themselves to using the physical plant that was developed for skiers. One hurdle for snowboarders is riding a chairlift, which was designed for easy on and off loading by skiers. The stance and binding system for snowboards is quite different from skis. Namely, the snowboard rider's feet are perpendicular to a single board, whereas a skier's feet are in-line with a pair of skis. As a result of these differences, a skier can move each foot independently to skate through lift lines and onto the chairlift, while a snowboarder has no such capability.

In order to ride chairlifts, snowboard riders must manually release one of the boots from its binding, and use this free boot as leverage to maneuver through the lift line and board the chairlift. Once on the chairlift, the board hangs from the fixed boot, straining the leg with the weight of the board. To alleviate this repetitive strain, boarders often rest the board on top of the free boot. Snowboards, however, have sharpened metal edges that are designed for carving turns in the snow and ice. As a consequence, the tops of snowboard boots, which are usually made of leather or fabric, often become marred and cut from repeated exposure to the board. Also, the metal edges of the snowboard may dull due to such repeated contact. Moreover, part of the attraction of snowboarding is that the participant wears soft-sided boots, which are quite dissimilar to the hard plastic sheathed boots of skiers. Snowboard boots provide a full range of biomechanical motion and are very comfortable. Therefore, any solution must retain the desirable qualities of snowboard boots, while still protecting the boot from damage and lessening the strain on the snowboarder's legs. As snowboarding is such a new sport, this problem has yet to have been addressed in any meaningful way.

One partial solution is a snowboard support and tether as described by Gomez et al. in U.S. Pat. No. 5,564,729. This invention comprises a harnessing system to support the board while riding the chairlift and to also tether the board to the rider. The user wears a harness that is composed of shoulder straps, a waist belt, and a strap that attaches to the snowboard. To ride a chair lift, the user gets on normally, but once aboard, the user cinches up the straps to support the weight of the snowboard. The weight is then distributed to the shoulder harness and waist belt, thereby alleviating some of the strain on the fixed boot.

An invention that seeks to protect athletic shoes is described by Brncick et al. in U.S. Pat. No. 5,074,060. This apparatus is constructed of plastic and is molded to the particular shape of a user's shoe. It comprises a covering for the distal end of a shoe, and is designed to protect the toes and the shoe from excessive injury. The apparatus is especially designed for sports, like skateboarding, where the participant drags a foot and potentially causes harm to the toes. This invention, however, is mainly designed for protecting the toes from injury, rather than the shoe itself.

An object of the present invention is to protect the free boot of a snowboarder from being cut or marred by the inside edge of the snowboard during the ride up a chairlift.

A further object of the present invention is to alleviate the strain on the fixed boot by enabling the free boot to carry part of the load during the chairlift ride.

Another object of the present invention is to provide a boot protector that does not impair the biomechanical motion of the foot.

A further object of the present invention is to provide a one-piece boot protector that is easy to use and simple to manufacture.

SUMMARY OF THE INVENTION

The above objects have been met with an auxiliary tongue, which is made of a strong, flexible plastic or rubber material, that intermediates between the snowboard and a conventional, free snowboard boot. Therefore, during a chairlift ride, the snowboarder can rest the snowboard on the tongue which is carried by the free boot without fear of damaging the boot. Also, since the fixed boot will no longer have to carry the entire load of the snowboard, the strain on that leg, and also the potential for injury, will be reduced. Furthermore, the snowboard boot protector does not impair the biomechanical performance of the foot and boot, nor the mechanical function of the binding.

BEST MODE OF CARRYING OUT THE INVENTION

Figure 1:
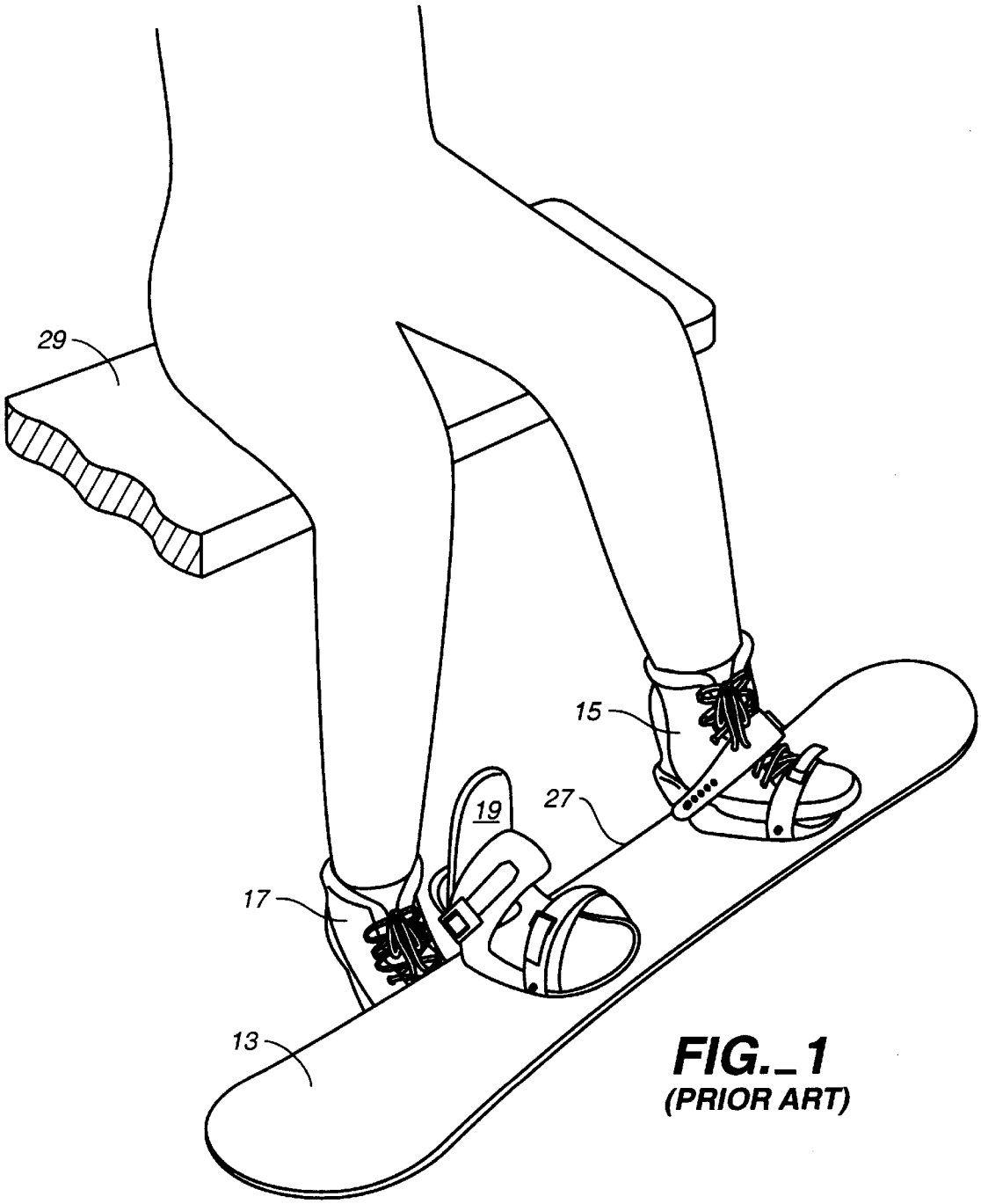
FIG. 1 (PRIOR ART)
FIG. 1 is a perspective view of a snowboarder sitting on a chairlift, showing how a snowboard is conventionally supported.

With reference to FIG. 1, the prevailing method of riding the chairlift 29 indicates the potential for damage when the snowboard 13 is rested on the free boot 17. When riding a chairlift 29, a snowboarder releases the binding 19 to produce a free boot 17. The fixed boot 15 remains bound to the snowboard 13 during all phases of use. During repeated contact, the metal inside edge 27 of the snowboard 13 scuffs and cuts the dorsal surface of the free boot 17. Even though a majority of the free boot 17 remains in good condition, a prematurely worn dorsal surface severely diminishes the usefulness of the free boot 17.

Figure 2:
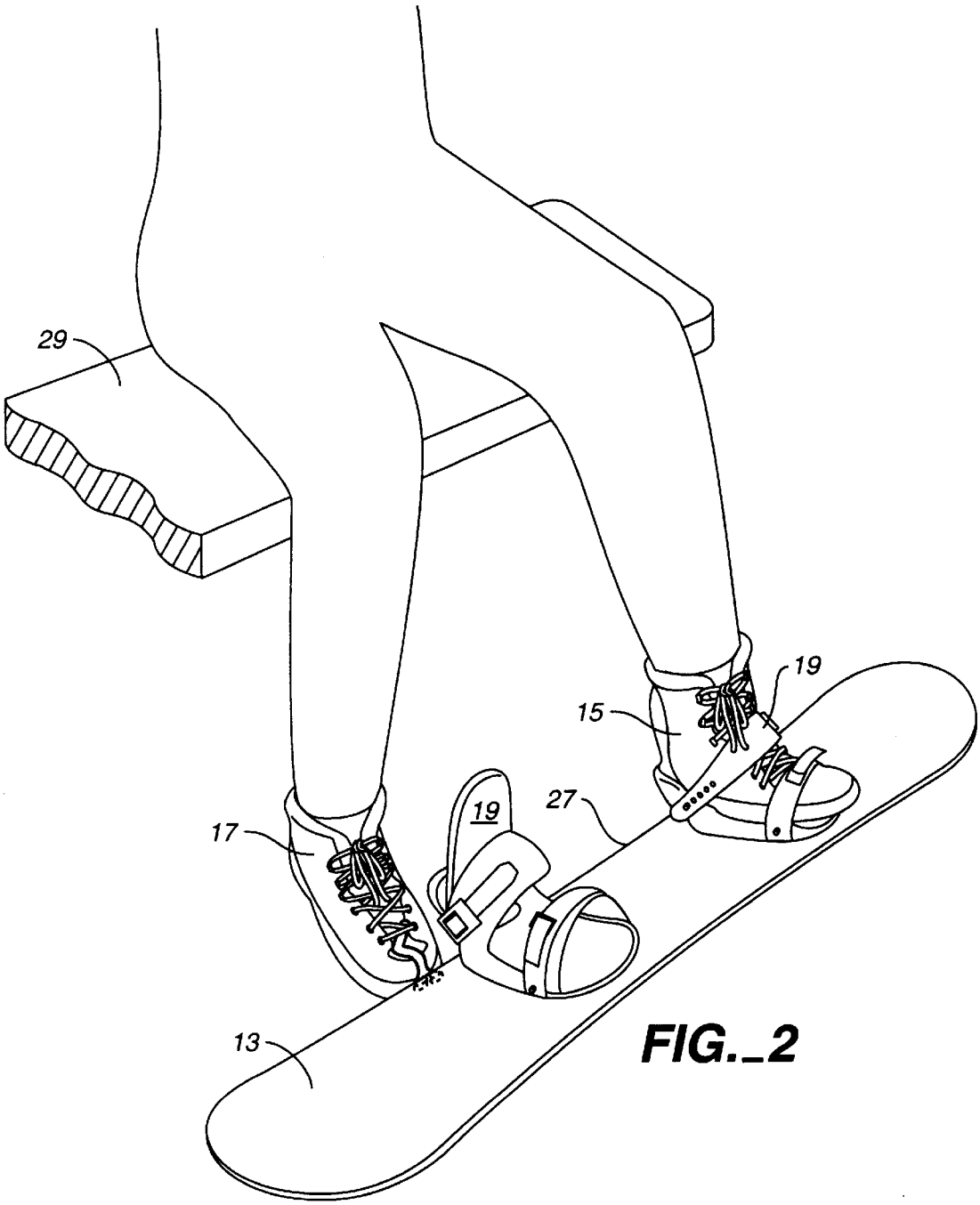
FIG. 2 is a perspective view of a snowboarder sitting on a chairlift, showing the boot protector of the present invention in use.

With reference to FIG. 2, the auxiliary tongue 21 shields a standard, free, snowboard boot 17 from the inside edge 27 of the snowboard 13. Auxiliary tongue 21 is an elongated structure placed below laces of the boot but above the regular tongue or top surface of the boot to prevent scuffing. On a chairlift 29 the user simply rests the free boot 17 underneath the snowboard 13. The tongue 21 intermediates between the free boot 17 and the snowboard 13, shielding the free boot 17 from any scratches or cuts. This apparatus further allows the snowboarder to transfer some of the weight of the snowboard 13 to the free boot 17, thereby alleviating some of the strain on the fixed boot 15.

The tongue 21 can be made out of any strong, yet flexible material, preferably plastic. Hardened rubber or other material could also be used, provided the material's properties remain constant through extreme temperatures. The tongue 21 should be sufficiently flexible so as to not impede with the normal operation of the boot and binding systems. Also, the tongue 21 should be strong enough to withstand repeated encounters with the snowboard 13 and the rigors of winter weather.

Figure 3:
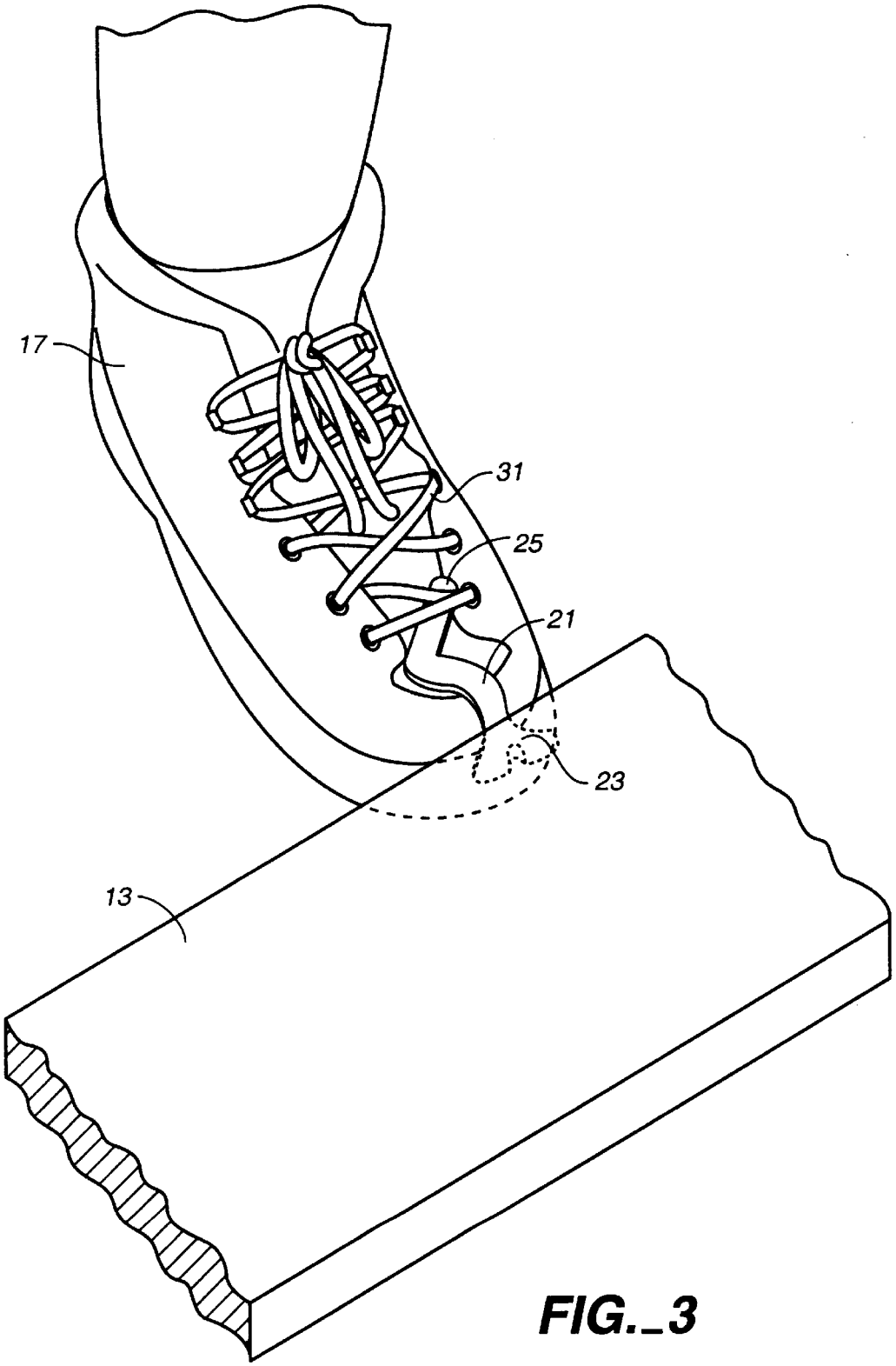
FIG. 3 is a front perspective view of the boot protector of the present invention.

With reference to FIG. 3, the tongue 21 has an elongate shape, perhaps 5 to 8 inches long, and is designed to be removably attached to the free boot 17. The proximal end of the tongue 21 has a connector 25, that attaches to the dorsal surface of the free boot 17. The attachment can be accomplished through the use of the boot laces 31, hook and loop fasteners, or other attachment means. Such attachment means, however, depend upon the design of the particular snowboard boot. All that is necessary is that the tongue 21 be securely affixed to the free boot 17. The distal end of the tongue 21 has a lip 23 perpendicularly formed that serves as a guide for engaging the snowboard 13. The lip 23 serves as a tactile warning that snowboard 13 is close to slipping off of the tongue 21. In addition, the tongue 21 could be removed from the free boot 17 and the lip 23 could be used as a snow scraper to remove debris from the snowboard 13.

Figure 4:
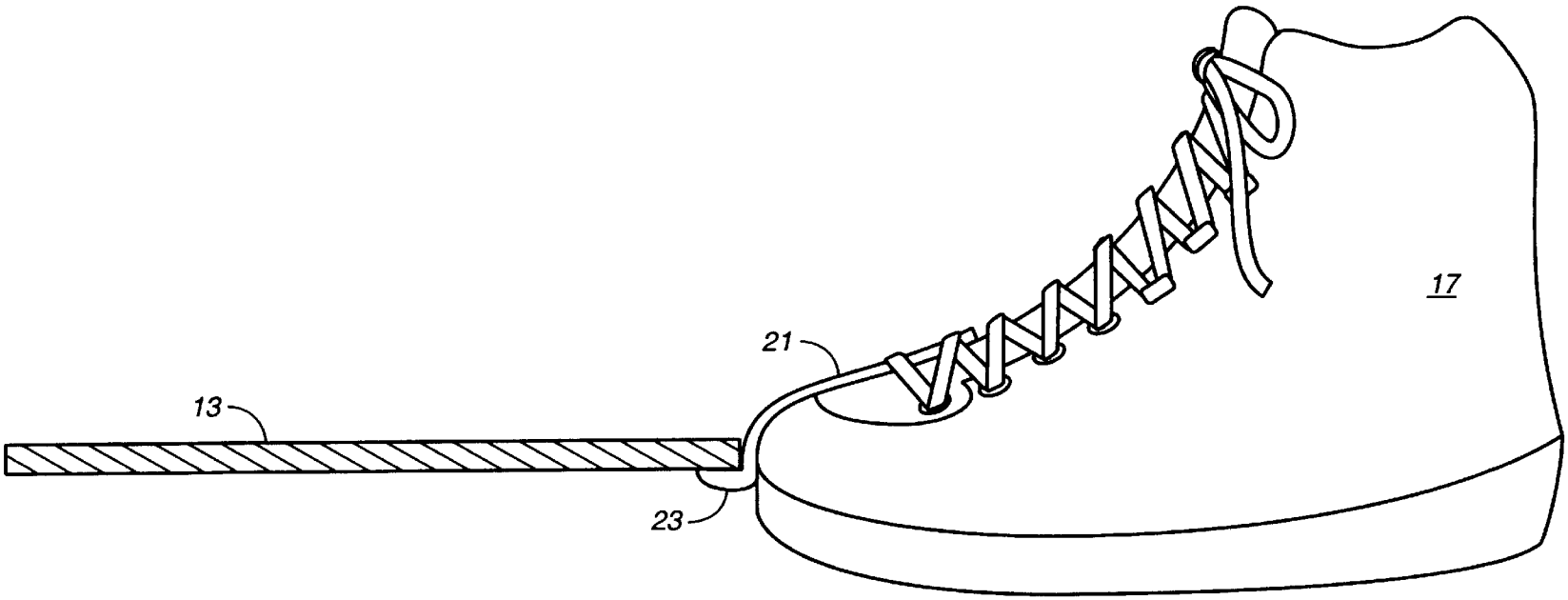
FIG. 4 is a side view, showing the boot protector according to the present invention interposed between a snowboard and a snowboard boot.
Figure 5A:
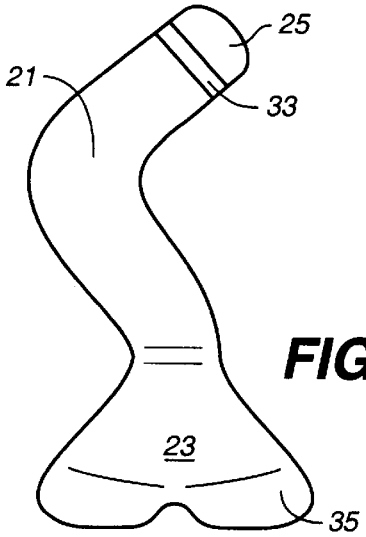
FIG. 5A is a top view of the boot protector shown in FIG. 2.
Figure 5B:
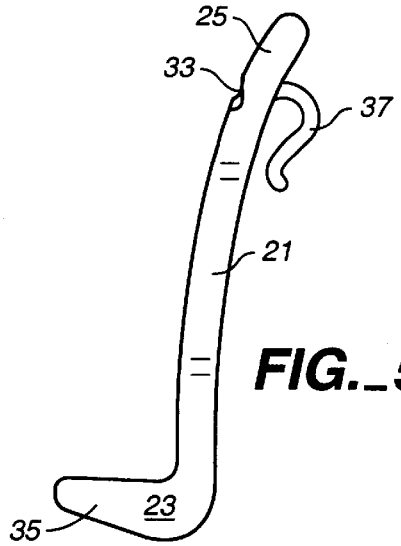
FIG. 5B is a side view of the device of FIG. 5A.
Figure 6A:
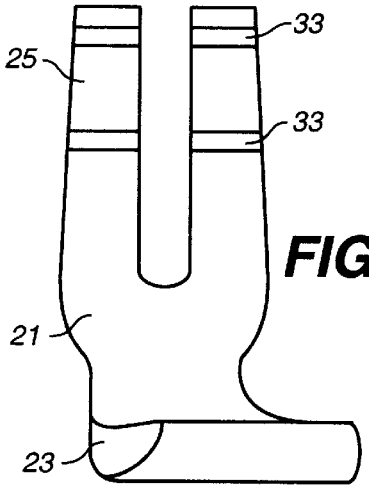
FIG. 6A is a top view of an alternate embodiment of the boot protector of the present invention.
Figure 6B:
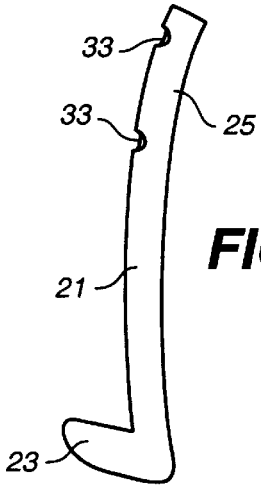
FIG. 6B is a side view of the device of FIG. 6A.

With reference to FIG. 4, the lip 23, having an engagement with the snowboard 13, protects the free boot 17 from damage.

With reference to FIGS. 5–8, several embodiments of the present invention show the variation in shapes that are effective as boot protectors. With reference to FIGS. 5A and 5B, the first embodiment is an s-shaped auxiliary tongue 21 for protecting a standard snowboard boot from injury. The tongue 21 has a top portion having a connector 25 with a groove 33 for securing the tongue 21 to the laces of a boot. The groove 33 comprises an indentation on the top surface of the tongue 21 that is sized to accept the boot lace 31, and when the boot lace 31 is drawn tight, the tongue 21 is secured. Also, a hook 37 is formed on the rear surface of the connector 25, corresponding to a loop disposed on the free boot 17 (not shown) or the boot laces 31 to provide a further engagement for the tongue 21. As an alternative, the connector 25 may have a plurality of lace conduits 39, providing means to thread the boot laces 31 and secure the tongue 21. A hook 37 may also be formed on the rear surface of the connector 25 to further fasten the tongue 21. A lip 23 is formed on the lower portion of the tongue 21 and has two equally sized prongs 35 that flare out from the tip of the tongue 21 to provide a wide base for mounting the snowboard 13. The second embodiment, with reference to FIGS. 6A and 6B, comprises an elongate tongue 21 with a two tined connector 25, shaped like a tuning fork, having dual grooves 33 on the top surface. The grooves 33 correspond to the boot lace 31, and interlock when the lace 31 is drawn tight. A plurality of lace conduits 39 may also be disposed through the sides of the two tined connector 25, allowing the boot laces 31 to be threaded through the lace conduits 39. The rear surfaces of the connector 25 may also have a plurality of hooks 37, providing further attachment means. A lip 23 is located on the bottom portion of the tongue 21 and is perpendicularly formed.

Figure 7A:
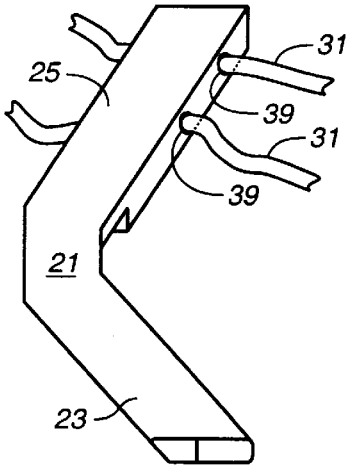
FIG. 7A is a top view of another alternate embodiment of the boot protector of the present invention.
Figure 7B:
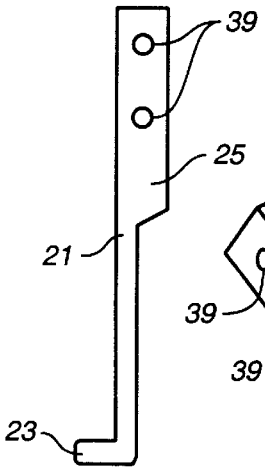
FIG. 7B is a side view of the device of FIG. 7A.
Figure 7C:
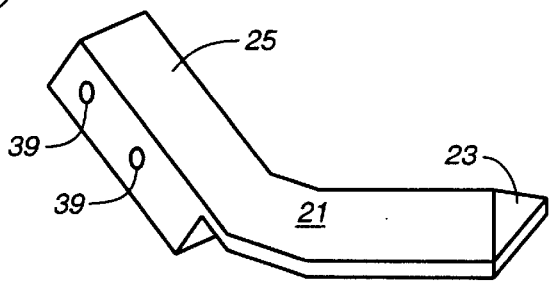
FIG. 7C is a view of the device of FIG. 7A.
Figure 8A:
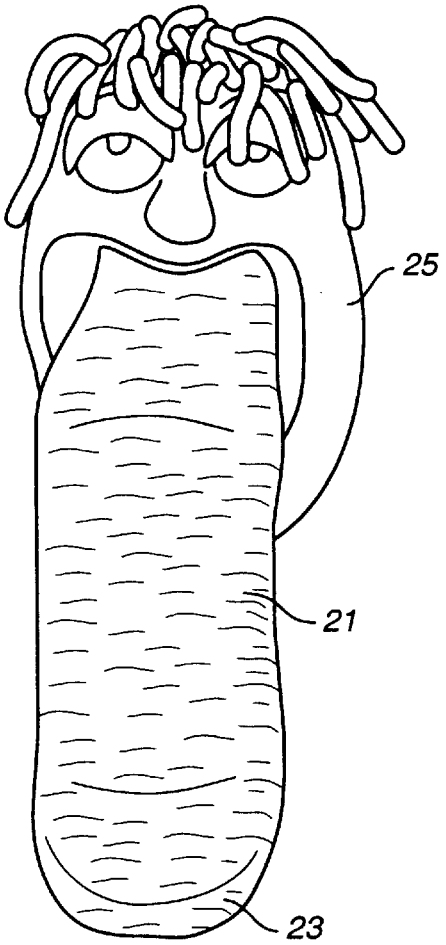
FIG. 8A is a top view of an alternate embodiment of the boot protector of the present invention.
Figure 8B:
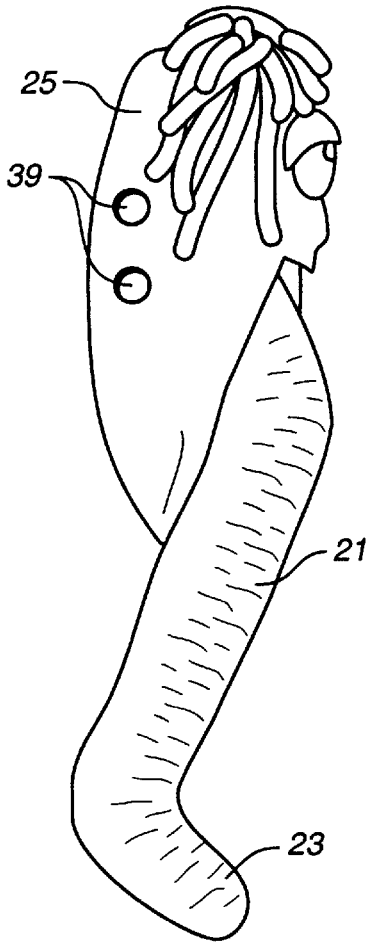
FIG. 8B is a side view of the device of FIG. 8A.

With reference to FIGS. 7A, 7B and 7C, the third embodiment is a tongue 21 having a top portion with a connector 25, a middle portion at an angle to the top portion, and a bottom portion with a lip 23 perpendicularly formed. The connector 25 has a plurality of lace conduits 39, disposed on the side of the connector 25, for interlacing the tongue 21 with the boot laces 31. The connector 25 may also have a plurality of grooves 33 on the top surface and a hook 37 on the rear surface, as alternative attachment means. With reference to FIGS. 8A and 8B, a decorative embodiment has a top portion with a connector 25 having a bulbous body shaped like a human head. An elongate body, shaped like an exaggerated human tongue, depends from the mouth of the head portion. Also, there are a plurality of lace conduits 39 formed through the sides of the connector 25. The lace conduits 39, when threaded with the boot laces 31 of a typical snowboard boot, serve as attachment means for the tongue 21. A hook 37 can also be formed on the rear surface of the connector 25, furthering the connection between the tongue 21 and the free boot 17. The distal end of the tongue 21 has an upturned portion that forms a lip 23 for interfacing with the snowboard 13.

What is claimed is:

1. A method for supporting a snowboard of the type capable of supporting a user wearing boots in at least one binding mounted between spaced-apart, parallel edges of the board while the user is seated in a chairlift comprising, providing a snowboard user an auxiliary tongue for a boot partially attached to the boot and projecting outwardly from the boot over a toe portion of the boot, the tongue having an upturned lip at an outwardly distal end thereof, and resting an edge of the snowboard on the upturned lip of the tongue while riding on a chairlift.

2. The method of claim 1 further defined by providing grooves in said tongue whereby said grooves interlock with laces of said boot.

3. The method of claim 1 further defined by providing said tongue with a bulbous shape opposite said outwardly distal end.

4. The method of claim 3 further defined by decorating said bulbous shape with artwork.

5. The method of claim 3 further defined by decorating said bulbous shape with an artwork suggestive of a human head.

6. The method of claim 1 further defined by providing said tongue with an s-shape.

7. The method of claim 1 further defined by providing said tongue with a tuning fork shape.

8. The method of claim 1 further defined by angularly offsetting an end of the tongue distal to the outward end.

9. The method of claim 1 further defined by turning the upturned lip downward with the snowboard, providing a seat for said edge of said snowboard.

10. The method of claim 9 further defined by shaping a part of the tongue nearest the lip to conform to a shape of a front end of said boot.

* * * * *